United States Patent [19]

Del Bon

[11] 3,937,371

[45] Feb. 10, 1976

[54] AUTOMATICALLY OPENING AND CLOSING CLOSURE DEVICE

[76] Inventor: Franco Del Bon, 9, Henzmannstrasse, 4800 Zofingen, Switzerland

[22] Filed: Jan. 10, 1974

[21] Appl. No.: 432,241

Related U.S. Application Data

[63] Continuation-in-part of Ser. No. 371,386, June 19, 1973, abandoned.

[30] Foreign Application Priority Data

Mar. 2, 1973 Switzerland ..... 2907/73
May 11, 1973 France ..... 73.17182

[52] U.S. Cl. ..... 222/494
[51] Int. Cl.[2] ..... B65D 25/40
[58] Field of Search ..... 222/491, 494, 498, 517, 222/527–529; 137/525.3, 525.5

[56] References Cited

UNITED STATES PATENTS

| | | | |
|---|---|---|---|
| 1,051,968 | 2/1913 | Petrie | 222/517 |
| 1,214,600 | 2/1917 | Silverthorne | 222/498 |
| 1,945,612 | 2/1934 | Lacher | 222/491 |
| 2,067,196 | 1/1937 | Lateur | 222/494 |
| 2,107,355 | 2/1938 | Winkler | 222/491 |
| 2,540,842 | 2/1951 | Stanley et al. | 222/494 |
| 2,753,091 | 7/1956 | Herzig | 222/491 |
| 3,602,407 | 8/1971 | Grothoff | 222/494 |

*Primary Examiner*—Robert B. Reeves
*Assistant Examiner*—H. Grant Skaggs, Jr.
*Attorney, Agent, or Firm*—Edwin E. Greigg

[57] ABSTRACT

An automatically opening and closing closure device adapted for use with a container having a liquid, pasty or foamy filling is described which comprises a head body, discharge duct means in the head body and having an orifice in the outside of the latter, the head body having an opening at a side thereof away from the discharge orifice and being destined for being joined to the container, the head body comprising a continuous integral wall portion about the discharge duct and orifice, the wall portion comprising an elastically flexible zone extending from part of the circumference of the orifice toward the opening, the remainder of the wall portion about the discharge duct and orifice being substantially rigid; and beak means comprising an elastically deflectable spring-loaded arm and being associated with the head body so that the free end of the arm is located on the side of the wall portion containing the flexible wall zone, the spring arm being biassed into engagement with the flexible wall zone near the orifice to hold the latter in sealing engagement with the rigid wall portion part and closing the orifice, the bias of the deflectable arm being so dimensioned as to yield to a determined excess pressure inside the discharge duct to cause the elastic zone of the wall portion to urge the free arm end away from the rigid wall part thereof and thereby to open the orifice, while the excess pressure prevails in the duct.

7 Claims, 9 Drawing Figures

AUTOMATICALLY OPENING AND CLOSING CLOSURE DEVICE

CROSS REFERENCE TO RELATED APPLICATION

This application is a continuation-in-part of my pending patent application Ser. No. 371,386 filed June 19, 1973 and now abandoned.

BACKGROUND OF THE INVENTION

This invention relates to an automatically opening and closing closure device for use with containers of liquids or pastes, which device comprises an essentially rigid cap portion having a discharge orifice and a discharge duct leading thereto, beak means for pressing upon a flexible closing means when the closure device is in closed condition, and spring means for urging the beak means against the flexible closing means, but yielding to a determined excess pressure in the discharge duct to release the beak means and to let the flexible closing means expand to permit a discharge of liquid or paste from the discharge orifice as long as the excess pressure in the discharge duct prevails.

This invention also relates to collapsible tubes equipped with a closure device according to the invention which device opens automatically when manual pressure is applied to a flexible part of the wall of the collapsible tube away from the cap portion of the closure device. Such tubes can be filled with pasty materials such as any products of highly viscous pasty consistency, for instance, ointments, dentifrice, shaving creams, oil paints, mustard, liverwurst, mayonnaise, shoe polish, pasty shampoo, facial creams and the like. The closure device according to the invention can also be applied to tubes and similar containers filled with a liquid product, in which case the closure device must be designed to act with a higher closing force than in the case of tubes filled with a pasty material.

All hitherto known commercially available closure devices for tubes for dispensing pastes and the like contents require three manual operations for each single dispensing step. A first operation involves removal of the closure device, e.g. the unscrewing of a screwed-on internally threaded cap, a second operation whereby the tube wall remote from the cap is compressed to squeeze a cord or string of the pasty contents out of the mouth of the tube, and a third operation comprising placing the cap back on the tube to cover the mouth of the latter and to screw on the cap, or a similar closing operation. In particular, the third operation often makes contact of the fingers handling the closure means with residual pasty material about the mouth of the tube unavoidable. Moreover, screwing on the cap may squeeze material left in the threading on the socket of the tube containing the mouth out from under the cap and such residual material will be decomposed and soil the fingers of the user when opening the tube again.

Various attempts going back to the year 1925 have been made in the past to provide closure devices which do not require unscrewing and screwing-on of caps or the like manual contact with the discharge outlet of a collapsible tube. However, such closure devices have either been far too complicated and costly to be commercially acceptable, or they have failed to seal off the contents of the tube satisfactorily. Among closure devices proposed are those of U.S. Pat. Nos. 1,753,665 to Roos granted 1930, 1,881,488 granted in 1932 to Gleason, 2,682,974 granted 1954 to Smith and 2,755,974 granted in 1956 to Godfrey. British Pat. Nos. 240,091 and 1,007,657 and German Pat. Nos. 436,054 and 876,980 may also be mentioned, while closure devices requiring some handling of the discharge outlet of a collapsible tube fail to meet the requirements that manual contact with the vicinity of the tube mouth should be completely avoided. Among the latter are German Pat. No. 589,805, Swiss Pat. Nos. 232,797 and 368,744, and U.S. Pat. No. 3,684,137, as well as Belgian Pat. No. 508,572.

OBJECTS AND SUMMARY OF THE INVENTION

It is therefore an object of the invention to provide a novel type of the closure device for collapsible tubes, pressure containers and the like, which avoids completely the need for a manual operation that would bring the fingers of the user into contact with the liquid or pasty contents of such tubes or containers, and which will at the same time assure a safe, completely automatic opening and closing achieving very satisfactory sealing of the discharge orifice of the device, depending exclusively on the pressure level prevailing in a discharge duct leading to the discharge opening of the device.

It is another object of the invention to provide a closure device of the above-described type which will be easy to manufacture requiring a minimum of one or two separate parts and a single assembly of the two parts.

It is yet another object of the invention to provide a closure device for a collapsible tube or the like container for the automatic dispensing of pasty or liquid material, whereby the user's fingers will not come into contact with the vicinity of the discharge opening of the closure device either before, during or after the dispensing of a quantity, e.g. a cord or string, of the contents of the tube or container, and wherefrom a cord of material can be dispensed simply and exclusively by compressing a part of the tube wall remote from the discharge opening in the closure device, or by pressure on a valve in the case of a pressure container. In the latter case, it is a particular, further object of the invention to effect the discharge from a closure device without leaving any residual liquid, pasty or foamy contents in the mouth of the device in contact with the outside air.

These objects are attained according to the invention by an automatically opening and closing closure device adapted for use with a container having a liquid, pasty or foamy filling which device comprises a head body, discharge duct means in the head body and having an orifice in the outside of the latter, the head body having an opening at a side thereof away from the discharge orifice and being destined for being joined to the container, the head body comprising a continuous integral wall portion about the discharge duct and orifice, the wall portion comprising an elastically flexible zone extending from part of the circumference of the orifice toward the opening, the remainder of the wall portion about the discharge duct and orifice being substantially rigid; and beak means comprising an elastically deflectable spring-loaded arm and being associated with the head body so that the free end of the arm is located on the side of the wall portion containing the flexible wall zone, the spring arm being biassed into engagement with thhe flexible wall zone near the orifice to hold the latter in sealing engagement with the rigid wall portion part and closing the orifice, the bias of the deflectable arm being so dimensioned as to yield to a determined excess pressure inside the discharge duct to cause the elastic zone of the wall portion to urge the free arm end away from the rigid part thereof and thereby to open the orifice, while the excess pressure prevails in the duct.

Due to the hermetic sealing of the discharge orifice by the closure device according to the invention, and due to the fact that no residual material is left after a discharge and subsequent automatic closing of the device, the contents of the tube or container are protected against decomposition under the influence of the surrounding air, in exactly the same manner as would be achieved when using a conventional screw cap. Moreover, the staining of the surroundings of the discharge opening and screwed-on cap by residual contents of the container are avoided.

The closure device according to the invention guarantees a prompt and hermetic sealing of the contents of the tube or other container as soon as pressure on the wall of the tube, e.g. by two fingers of the user, ceases.

In a first embodiment, the spring means are constituted as an elastic compressible and resilient member which engages the inside of the beak means between the latter and the adjoining rigid cap portion adjoining in turn a flexible wall portion which is engaged by the free end of the beak means. The spring means may engage the lever arm comprised by the beak means which is remote from the free end of the latter, e.g., upstream of the pivoting axis of the beak means.

Such elastic spring member will urge the beak means part, upstream of the pivoting axis thereof, in a direction out of the cap portion and thereby press the free beak end strongly against the flexible wall portion, thereby keeping the discharge opening closed.

Such elastic resilient spring member may be mounted on or be integral with the above-mentioned lever part of the beak means or it may be mounted on or be integral with the adjoining rigid cap portion, only the spring member being made of resilient, elastic and compressible material while the remaining cap portion or beak parts are rigid. When integral with the cap portion, the elastic spring member may be in the shape of a leaf spring projecting from the wall of the rigid cap portion and engaging the beak means.

In a preferred embodiment, the rigid cap portion can be provided with a flat frontal face on which the collapsible tube or container can be made to stand upright, when being placed on a horizontal smooth surface. In this case the discharge opening is located preferably in a lateral wall portion of the rigid cap adjacent the flat frontal face thereof.

When the closing effect of the beak and spring means assembly of the closure device according to the invention is sufficiently strong, the tube or other container to which the closure device is attached may be filled with a liquid product instead or a product of pasty or foamy consistency. Even aqueous or alcoholic liquids such as mouth wash can be discharged with the aid of closure means according to the invention.

The closure device according to the invention may also be used as an acutating head for a pressure container from which a liquid, pasty or foamy product is to be dispensed and which is stored in the container under pressure of a liquefied gas such as dichlorodifluoroethane (Freon 12) carbon dioxide, dimethyl ether, nitrogen suboxide or the like. Such pressure containers are equipped with a valve comprising a valve member which protrudes from the remainder of the valve and is depressed by means of an actuating head in order to open the valve. When the closure means according to the invention are used as such actuating head, the recess on the underside of the device which may be screwed onto the socket of a tube or fastened thereon in a similar manner, must be fixed on the protruding end of the valve member. The closure device will then open and close automatically in the manner described hereinbefore, and especially it will prevent residue of the contents to stick to the vicinity of the discharge opening and become decomposed as is the case with known devices.

This is particularly important when pasty or foamy food products are to be dispensed which might be decomposed by bacteria.

In a particularly simple embodiment of the closure device according to the invention which solves particularly well the problem of providing for a hermatic, fully satisfactory closure after each dispensing operation, a rigid cap portion of the closure device has a discharge orifice and a passage leading to the latter, which passage is surrounded on all sides up to the discharge opening and from its entry opening at the bottom face of the cap portion, by a continuous wall which is formed, on one side of the passage by a rigid nose portion being integral with the cap portion, and on the opposite side by a flexible, expandable wall portion being also integral with the cap portion and with the wall portion; the closure device, in this embodiment thereof, further comprises a beak portion projecting from the cap portion beneath the root of the flexible wall portion in the cap portion away from the orifice, which beak portion is rigid and is joined to the cap portion, being preferably integral therewith, by means of a hinge portion which is flexible about an axis transverse to the direction in which the passage extends, and which beak portion is biassed in the direction toward the flexible wall portion and presses the latter at its outer rim adjacent the orifice against the opposite rigid nose portion, thereby hermetically sealing the orifice; the elasticity of the hinge portion is so dimensioned that at a determined excess pressure in the interior of the passage, the beak portion will yield and set free the flexible wall portion which will be bent outwardly and expand, thereby opening the orifice.

Further objects of the invention will become apparent from the subsequent description thereof in connection with the drawings which illustrate non-limitative embodiments of the closure device according to the invention.

DETAILED DESCRIPTION AND OPERATION OF THE EMBODIMENTS

Figure 1:
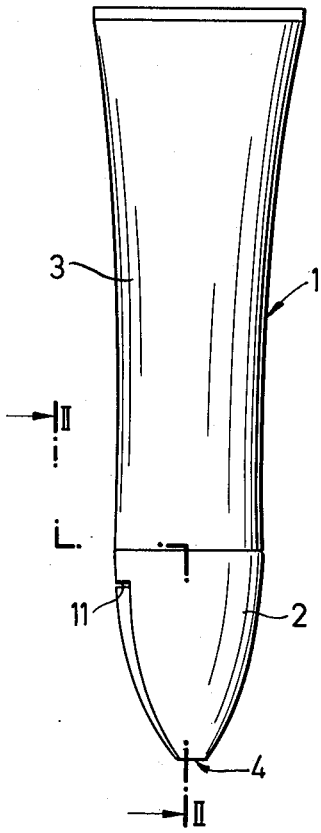
FIG. 1 represents a lateral view of a first embodiment of a closure device according to the invention screw-connected to a collapsible tube.
Figure 2:
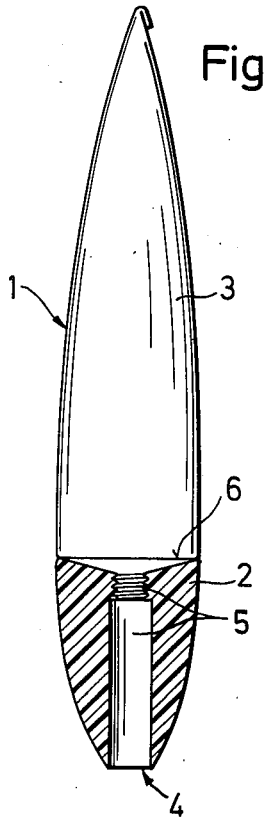
FIG. 2 shows a sectional view the closure device and the one-piece tube of FIG. 1 along the lines II—II in FIG. 1, but turned about an angle of 90°, in closed condition.

A collapsible tube which is shown in FIGS. 1 and 2, equipped with a first embodiment of the closure device according to the invention, comprises a tube shell 1, consisting preferably of a thermoplastic resin material such as polyvinyl chloride, polyethylene, polypropylene, acrylic resin or the like elastic polymerizate; the tube shell 1 may also consist of collapsible aluminum or of a laminate of thermoplastic resin and a metal foil covering the interior of shell 1, preferably a foil of aluminum metal, whenever the filling requires such inner cover or coating for protection of the contents during long time storage, in order to avoid corrosion or losses due to diffusion through the shell wall.

The manufacture of articles of synthetic plastics materials by injection molding techniques is so well known that a more detailed description thereof can be dispensed with. Hardening of thermoplastic articles or portions of such articles is also a well-known technique. Hardening by heating to a relatively high temperature for a very short time (150° to 200° for a minute or a few minutes) is preferred as it is easier to localize the heating and to harden only certain parts while leaving other parts of the molded article flexible. The exact treatment depends so much on the composition of the thermoplastic material and so much variation is possible that no further details can be given here; moreover, experts in the thermoplastics art are familiar with these details.

Figure 3:
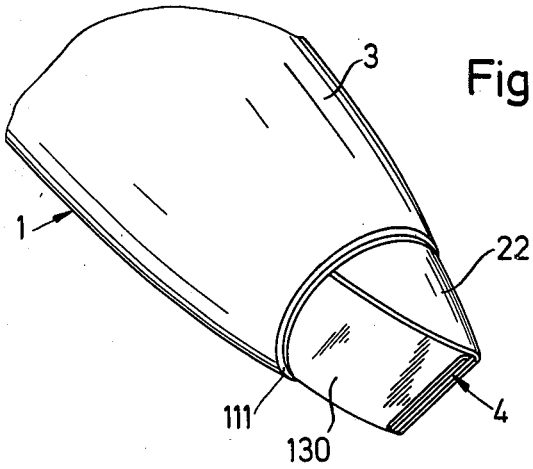
FIG. 3 is a perspective view of another embodiment of a closure device with the one-piece tube of FIG. 1.
Figure 4:
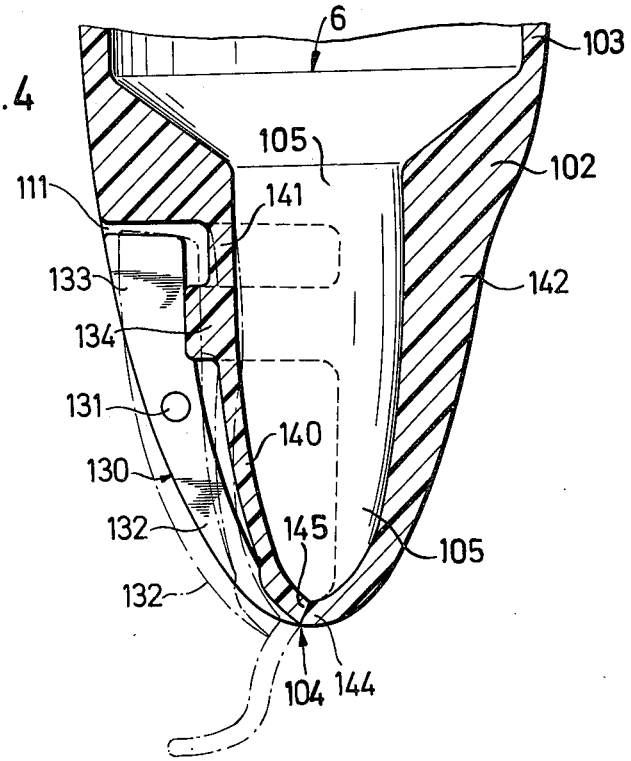
FIG. 4 is an axial sectional view of another embodiment of a closure device according to the invention, being constituted by only two parts and being integral with a collapsible tube.
Figure 5:
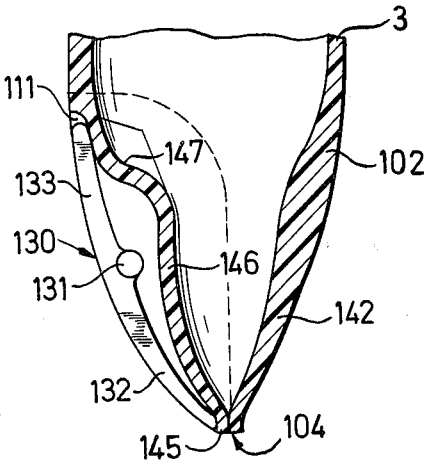
FIG. 5 is an axial sectional view of an embodiment similar to that shown in FIG. 4, but consisting only of two parts.
Figure 6:
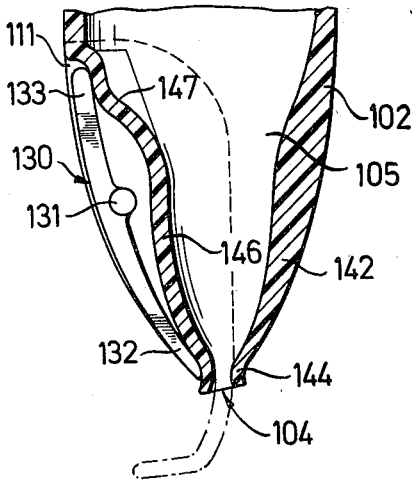
FIG. 6 shows the same embodiment as in FIG. 5, but with the discharge opening in open position.

Shell 1 is screw-connected as in FIGS. 1 to 3 to, or integral as in FIGS. 4 to 6 with, a thick-walled rigid cap portion 2 of a closure device according to the invention, which does not alter its shape when manual pressure is applied thereto or to the flexible shell portion constituted by wall part 3 which can be easily compressed, e.g. by two fingers of the same hand of the user.

The material from which the flexible shell wall 3 is made is preferably so elastic that the wall will have a strong tendency to resume its original uncompressed shape, when pressure thereon ceases, and, as far as feasible, to return the paste remaining therein to the same shape. On the other hand, when an aluminum or the like metal tube is used, the same can be rolled up from the end thereof opposite the closure device according to the invention, progressively as the contents therein have been discharged.

The cap portion 2 is provided at its rigid discharge end with an discharge orifice 4 for discharging contents of the tube shell 1 therethrough when open. Cap portion 2 has a central duct 5 therethrough leading from the opening 6 of the cap portion opposite the discharge orifice 4 to the latter.

In FIGS. 4 to 6, cap portion 102 is an integral rigid head portion of the otherwise flexible tube wall 103. The head portion 102 of the closure device is provided with an axial passage 105 having a discharge orifice 104. A lateral axially extending groove or recess 111 which forms a longitudinal slot in the sidewall of head portion 102 is separated from the axial passage 105 by a highly elastic resilient wall portion 141, 147 of little flexibility from which the highly flexible and preferably elastically expandable wall portion 140, 146 depends. Flexible wall portion 140, 146 and a rigid wall part 142 of the head portion 102 surround axial passage 105 and the discharge orifice 104 as a continuous uninterrupted wall, wall part 142 forming a rigid rim part or lip zone 144 and flexible wall 140, 146 a flexible rim zone 145 thereabout. In recess 111 there is lodged a beak member 130 pivotal about pins 131 constituting a rotary axis transverse to the central axis of the closure device. The portion of beak member 130 extending from the rotary axis thereof toward the tube body constitutes a lever arm 133 and the opposite portion extending from the rotary axis to the discharge orifice 104 constitutes a second lever arm 132. In closed position this lever arm 132 squeezes with its free end the flexible wall portion 140, 146 and closes the opening 104 sealingly to prevent any escape of the contents of the tube or other container to which the closure device is connected. Of course, the spring member could also be made integral with lever portion 133 of beak member 130. The techniques of making the main body of beak member 130 or head portion 102 rigid while keeping a protrusion on the inside of lever arm 133, or the wall flange 134, relatively compressible and elastically resilient are well known in the art of manufacturing thermoplastics articles. Thus, a flexible compressible elastic plug can be glued or ultrasound welded onto the inside of lever arm 133. In these embodiments, the spring member has the function of returning the beak member 130 to closing position as soon as a determined increased pressure of the contents of a tube or container connected to the closure device exerted in duct 103 creases. The embodiments of closure devices shown in FIGS. 1 to 6 require two structural elements, namely the head portion and the beak member.

More in particular, the rigid wall portion 141 (FIG. 4) bears at its end where the flexible wall portion 140 begins, a projection extending radially with regard to the central head portion axis and constituting the spring member 134. The latter engages the inside face of the lever part 133 of beak member 130 and urges it in a direction out of recess 111, thereby pivoting beak member 130 about its rotary pins 131 and pressing lever part 132 of the beak member against the outermost end 145 of flexible wall portion 140 dependent from rigid head portion 102, thus hermetically sealing the discharge orifice 104 formed between the flexible wall portion 140 and the rigid wall portion 142 of the head portion 102. When the discharge orifice is open the rim of the flexible wall portion 140 may form a lunar or a near semicircle the chord of which is formed by the flat, slightly inwardly rim 144 of the rigid wall portion 142.

When pressure is increased sufficiently in the duct 105 leading toward orifice 104, the beak member lever part 132 will be forced outwardly from recess 111 into the position indicated by phantom lines in FIG. 4 and a string of paste or a squirt of liquid will be released from the closure device. At the same time, the elastic, resilient projection 134 will be compressed by the lever part 133 of beak member 130, against rigid wall portion 141 dependent from head portion 120, and, when pressure inside the closure head is relieved, projection 134, acting as the spring member of the device, will return lever part 133 to its outward position and thereby urge lever part 132 against the outer end of flexible wall portion 140 and the latter into hermetically sealing contact with rigid wall portion 142 at its rim 144.

In the embodiments of FIGS. 5 and 6, actuation of the beak member 130 is similar as in FIG. 4 but the function of spring projection 134 is replaced by a highly elastic, but only slightly resilient wall portion 141, 147 intermediate the flexible wall portion 140, 146 and the rigid cap portion 102 has itself the function of spring member 134.

FIG. 5 shows the closure device with discharge orifice 104 closed, and elastic wall portion 147 pressing against the inside of lever part 133 of beak member 130, while FIG. 6 shows the device with orifice 104 open and a cord of material emerging therefrom, while the end of lever part 133 of beak member 130 slightly deforms elastic wall portion 147 inwardly, thereby giving it a bias which will return the beak member 130 to its orifice-closing position as shown in FIG. 5.

In the embodiments of the closure device shown in FIGS. 1 to 6 the spring member 134, 147 which urges the beak member 130 against the flexible wall portion 140, 146, when no pressure is exercised on the tube wall 103, acts on the beak member 130 from the interior of the axial groove 111 in the head portion 102 housing the beak member 130, and not on the external surface of the latter. Apart from the groove or recess housing the beak member, the head portion can, therefore, present an uninterrupted outer surface.

The feature of a slot between the rigid wall part 142 and the flexible wall portion 140, 146 constituting the orifice 104 instead of providing the orifice as an open end of a hose of rubber or the like resilient, flexible material, offers a greatly improved sealing effect in the closed position.

The wall of the rubber hose surrounding the discharge orifice will bulge at both terminal edges when compressed by the free lever arm of a beak member, provided in many known closure devices. Consequently, then strings of material will still emerge from the bulging ends of a hose which is already completely compressed in a straight line in the central zone thereof. An additional amount of pressure will have to be applied to the beak member to completely flatten the marginal bulges. Such additional pressure must, however, be counteracted by a correspondingly higher pressure on the flexible tube wall. The feature of a slot provided between the rigid wall part 142 and an elastic, deformable wall portion 140, 146, along which slot, when closed, the latter wall portion extends, throughout, parallel with the rim of the rigid wall part 142 and merges with the latter at an acute angle and without any rounded wall portions causing bulging when being closed, ensures a greatly superior sealing effect achieved with a weaker bias on the free end of the beak member, and correspondingly lower pressure increase needed to discharge filling from the interior of the tube or container connected to the closure device according to the invention.

Figure 7:
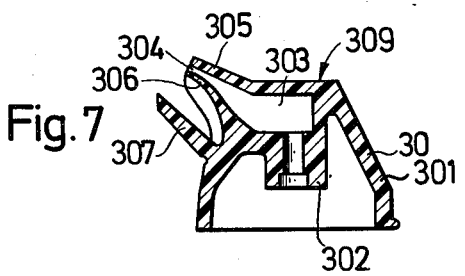
FIG. 7 is a sectional view of a preferred embodiment of the closure device according to the invention, in the form of a workpiece obtained by injection molding before a bias is applied to the beak portion thereof.
Figure 8:
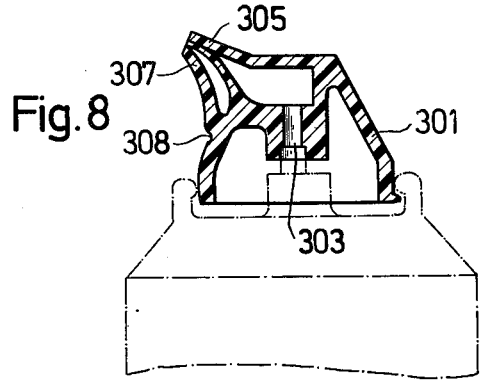
FIG. 8 shows the same embodiment in a similar view, but after application of the bias to the beak portion, the closure device thus being in closed position.
Figure 9:
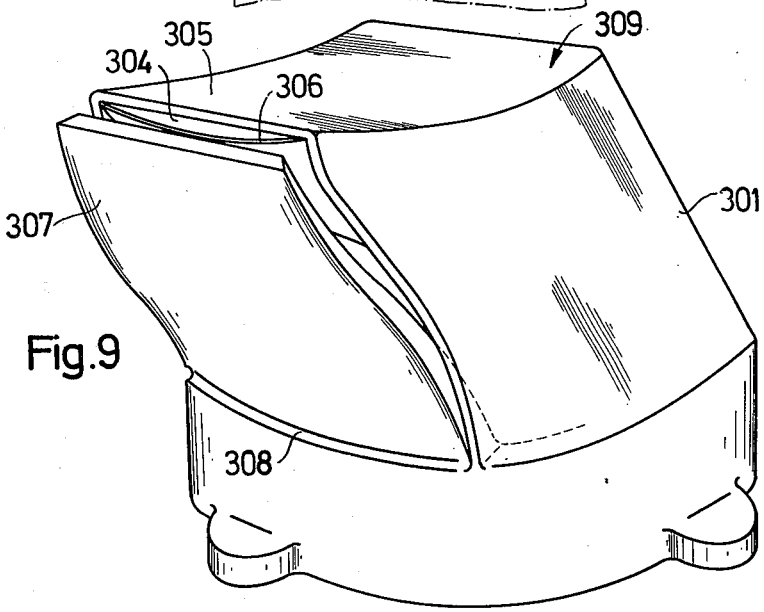
FIG. 9 shows the same closure device in perspective view, with the beak portion and flexible wall portion thereof in open position.

The closure device shown in FIGS. 7 to 9 which is made from a known synthetic material, e.g. polyvinyl chloride, polyethylene, polymethyl acrylate or methacrylate or the like by means of injection molding, consists of a rigid cap portion 301 which is open on its bottom face to be joined to a pressurized container or a collapsible tube provided with a conventional mouthpiece. A central tubular part 302 serves for engaging, for instance, the movable valve member of a discharge valve of the pressurized container. From the open bottom end of cap portion 301, a passage 303 leads through tubular part 302 to a discharge opening 304; passage 303 is surrounded on all sides by an uninterrupted wall the upper zone of which is formed by the rigid nose portion 305 which is integral with the cap portion 301 while the lower zone of the surrounding wall is formed by the thin, flexible and/or expandable wall portion 306 which is integral with the nose portion 305 and the cap portion 301. Outside the passage 303 a rigid beak portion 307 projects from the cap portion 301, which beak portion 307 is connected with the cap portion 301 at the root of the flexible wall portion 306 by means of a flexible hinge portion 308, which is formed with the aid of a transverse groove in the cap portion 301 at the root of beak portion 308. The work piece obtained by injection molding in the shape illustrated in FIG. 7 is converted to the finished closure device shown in FIG. 8 in closed position, by hot pressing the projecting beak portion from the position thereof shown in FIG. 7 to the position shown in FIG. 8. Thereby, beak portion 307 is given a permanent bias exerting pressure with its free top end on the outside of the top end of flexible wall portion 306. This method of forming the hinge at 308 is preferably carried out by welding the beak portion 307 onto the cap portion 301, although the former method is within the scope of the present invention.

While FIG. 8 shows the closure device with its discharge opening 304 in closed position, FIG. 9 shows the closure device in perspective view with its discharge opening 304 opened owing to a deformation of flexible wall portion 306 under the effect of an excess pressure prevailing in the interior of passage 303.

This excess pressure may, for instance, be caused by depressing the closure device when the latter has been mounted on the movable valve member of the valve of a pressurized container, to serve as an actuating pushbotton head for the latter. Closure device cap portion 301 can be depressed by finger pressure on the pressure face 309 whereby the discharge valve of the pressurized container will be opened. Thereby, paste or a foamy product will be squeezed through passage 303 against the inside of flexible wall portion 306 and will deform the latter and deflect rigid beak portion 307 outwardly while being discharged through orifice 304. Release of the closure device by ceasing pressure on face 309 will cause the discharge valve of the container to close, whereupon the excess pressure in passage 303 ceases also, and beak portion 307 presses the upper rim of the flexible wall portion 306 firmly against the nose portion 305, thereby hermetically sealing orifice 304.

It is also possible to provide tubular portion 302 with an outer or inner threading and to screw it onto a corresponding inner or outer threading of the mouthpiece of a collapsible tube. By exerting pressure on the wall of the collapsible tube remote from the closure device according to the invention, paste or liquid will then be dispensed from the tube through orifice 304 as from a standard tube.

The cord which is squeezed out of a tube equipped with a closure device according to the invention is usually not of circular, but of flat rectangular or elliptic cross sectional area. While it easily happens, when squeezing a cord of toothpaste from a conventional tube onto a toothbrush, that the chord will drop from the bristles of the brush, this is much less likely to occur when using a tube having a closure device as described hereinbefore, when the tube is held with squeezing edge of the beak member parallel to the top surface of the bristles, so that the cord rests securely with its flat side on the bristle ends.

A tube provided with a closure device according to the invention may even be used for dispensing glues or the like sticky materials. To the extent that these glues, upon drying, may combine with the material of the flexible wall portion, it is necessary to coat the internal wall of the latter with a material inert to the glue. Such coating may consist of a thin flexible metal foil, preferably a very thin aluminum foil as present in so-called laminates.

What is claimed is:

1. Automatically opening and closing closure device adapted for use with a container having a liquid, pasty or foamy filling, comprising a head body having a discharge duct extending therethrough, an orifice in the outside of the discharge duct, a recess and an opening at a side of the head body away from said discharge orifice and being destined for being joined to said container, said head body comprising a continuous integral circumferential wall portion about said discharge duct and orifice, said wall portion comprising an elastically flexible zone extending from part of the circumference of said orifice toward said opening, said flexible wall zone forming at least a part of the bottom of said recess, the remainder of said wall portion about said discharge duct and orifice being substantially rigid, where the wall of the discharge duct and the head body are formed as one piece; a spring member provided at the base of said flexible wall zone; and beak means mounted in the recess of said head body and comprising a two-armed lever, one arm of which engages the spring member and the other arm of which is formed as an elastically deflectable spring-loaded arm associated with said head body so that the free end of said arm is located on the side of said wall portion containing said flexible wall zone, said spring-loaded arm being biassed into engagement with said flexible wall zone near said orifice to hold the latter in sealing engagement with said rigid wall portion part and closing said orifice, the bias of said deflectable arm being so dimensioned as to yield to a determined excess pressure inside said discharge duct to cause said elastic zone of said wall portion to urge the free arm end away from said rigid part thereof and thereby to open said orifice, while said excess pressure prevails in said duct.

2. A closure device as described in claim 1, wherein said spring member engages the inside of said beak means and is integral with the rigid part of said wall portion adjoining the flexible wall zone which is engaged by the free end of said deflectable arm.

3. A closure device as described in claim 1, wherein said flexible wall zone has non rounded edges at its two ends joining said rigid wall portion.

4. In a two-part closure device of plastic material, for use with a container for liquid or pasty material, having a compressible wall, the device comprising: a one-piece head part ending in a discharge orifice and having a recess extending in the direction of the longitudinal axis of the device and up to the edge of the orifice, and an axial through passage ending in the orifice, that wall zone of said passage which is turned toward said recess being elastically flexible and that wall zone which is opposite the former wall zone as well as the remaining head part being substantially rigid; and a beak member extending essentially in the direction of the longitudinal axis of the device, said beak member being mounted in the wall of the head part surrounding said recess, and being devised as a two-armed lever, one arm of which extends toward said discharge orifice and is pivotable toward said elastically flexible wall zone for the purpose of closing said discharge orifice, the improvement in combination, wherein the other arm of said two-armed lever beak member extends away from said discharge orifice and rest with bias against a deformable wall portion at the rearward end of the elastically flexible wallzone away from the discharge orifice of said recess; and the elasticity of the deformable wall portion being such that the end of the beak member facing toward the discharge orifice closes the latter sealingly and frees the discharge orifice when pressure is exerted on the compressible wall of the container.

5. The improvement as described in claim 4, wherein the deformable wall portion is deviced as a compressible protrusion.

6. The improvement as described in claim 5, wherein the compressible protrusion is in the form of a semicircular bead extending transverse to the longitudinal axis of the device.

7. The improvement as described in claim 4, wherein the deformable wall portion is located in the recess away from the discharge orifice and is more difficultly deformable than the flexible wall zone extending to the orifice.

* * * * *